United States Patent [19]

Grifoni

[11] Patent Number: 4,727,257

[45] Date of Patent: Feb. 23, 1988

[54] SHIELD AGAINST RADIATIONS

[76] Inventor: Sergio Grifoni, 2/A/6, Via Capolungo, Genova, Italy

[21] Appl. No.: 821,192

[22] Filed: Jan. 22, 1986

[51] Int. Cl.[4] ..... G21C 11/00

[52] U.S. Cl. ..... 250/518.1; 250/517.1; 250/515.1; 106/97

[58] Field of Search ..... 106/89, 97; 250/517.1, 250/518.1, 515.1

[56] References Cited

U.S. PATENT DOCUMENTS 2,726,339 12/1955 Borst ..... 250/518.1
3,122,513 2/1964 Dempsey ..... 250/517.1
4,123,392 10/1978 Hall et al. ..... 106/90

FOREIGN PATENT DOCUMENTS 2516023 10/1976 Fed. Rep. of Germany ... 250/517.1
2004406 3/1979 United Kingdom ..... 250/517.1

*Primary Examiner*—Steven Capella
*Attorney, Agent, or Firm*—Pollock, Vande Sande & Priddy

[57] ABSTRACT

A shield against ionizing radiations comprises at least one layer including one or more boron minerals and/or one or more lead minerals and/or directly derived products, which preferably constitute the inert or slightly active aggregate fraction of cement-based conglomerates (such as concrete or mortar). Galena and/or other lead minerals can be used for the shielding from $\gamma$ rays, and colemanite and/or other boron minerals can be used for neutron shielding. Particular purpose additives will also be used. The family of compositions according to the invention will contain by weight 65–75% of floated galena, 5–10% of colemanite and 20–25% of binding agents and additives.

8 Claims, No Drawings

SHIELD AGAINST RADIATIONS

FIELD OF THE INVENTION

The present invention relates to a shield against ionizing radiations, comprising at least one layer consisting of a cement based conglomerate which contains, as a substitute of the inert aggregate fraction, one or more lead minerals and/or one or more boron minerals and/or their directly derived products.

The advantage of using the above mentioned minerals or their directly derived products resides in the fact that then are more easily available than industrial chemical products, and have physical properties (grain size and distribution, surface roughness, etc.) close or more similar to the ones of the inert aggregates used in cement-based concretes and mortars.

The reason for using lead minerals in the shield, rather than baryta or iron minerals or manganese minerals, is that, for equal weights, lead is much more efficient in shielding against X-rays and $\gamma$-rays than any other readily available element. The higher cost of lead as a commercial metal (in comparison with iron or manganese) is abundantly compensated by the higher efficiency of the shield thus obtained.

According to a preferred embodiment of the invention, a particular family of shielding compositions has been found to be well suited to constitute the biological shield of a nuclear reactor (particularly a Boiling Water Reactor).

DESCRIPTION OF THE PREFERRED EMBODIMENT

According to the invention, one layer of cement-based conglomerate or mortar contains a composition belonging to the following family:

Galena: 65–75% by weight
Colemanite: 5–10% by weight
Binding agents: 15–20% by weight
Additives: 5–10% by weight The mixture obtained with the above listed materials is then mixed with water for immediate use.

The additives in the above composition have a very important role, in consideration of the fact that the shielding material must satisfy a number of additional needs, i.e.:

to remain fluid for a sufficient time after preparation;
to be poured or pumped into the compartments of the shielding structure;
to expand inside the compartments to fill small voids;
not to shrink during the hardening process;
not to corrode the walls of the shielding structure.

Basic additives are: sulphonates, chelate forming agents, aerating agents, expanding agents.

Moreover, in order to avoid problems at the construction site, the wet mixture must not have a specific weight much higher than the weight of ordinary concrete. The specific weight of the mortar must therefore be in the range of between 2.5 and 3.5 g/cm$^3$.

In order to obtain the above mentioned results, floated galena (i.e., galena obtained with flotation methods) can be used, which presents a grain distribution comprised, by way of example, between 5 and 80$\mu$. To the floated galena a small quantity of silver can be added.

The shielding layers thus obtained are very effective against $\gamma$,$\beta$ and $\alpha$ rays, as well as against fast and slow neutrons. The efficiency against neutrons will be best if all the water is kept in the shield. The efficiency is still very good however, if the shield is allowed to dry (in this case just the reaction, hydration and adsorbed water is kept).

The final shield will contain:
lead, at least 38% by weight;
boron, at least 0.6% by weight;
hydrogen, at least 1.5% by weight (wet shield), or
hydrogen, at least 0.7% by weight (dry shield).

The shield will preferably be maintained in wet condition.

Of course the invention is not limited to the above described preferred embodiment, but it can be broadly varied and modified, particularly as concerns the equivalents of the various components. Thus, for example, the lead minerals may comprise, besides galena, also cerussite or anglesite, while the boron material may comprise, besides colemanite, also borax or ulexite.

I claim:

1. A shield against ionizing radiations that comprises at least one layer of an aggregate-containing cement-based conglomerate or an aggregate-containing cement-based mortar wherein the aggregate consists essentially of floated galena or mixtures thereof which at least one boron mineral.

2. The shield of claim 1 wherein said galena has a grain distribution between 5 and 80$\mu$.

3. The shield of claim 1 wherein said aggregate consists essentially of a said floated galena and at least one boron mineral.

4. The shield of claim 3 wherein said boron mineral is selected from the group consisting of colemanite, borax, ilexite, and mixtures thereof.

5. The shield of claim 1 which further contains at least one additive selected from the group consisting of sulphonates, chelate forming agents, aerating agents, expanding agent, and mixtures thereof.

6. The shield of claim 5 which comprises by weight floated galena 65–75%; colemanite 5–10%; cement binding agents 15–20%; and additives 5–10%.

7. The shield of claim 1 which, after the addition of water and as a wet mixture has a density between 2.5 and 3.5 g/cm$^3$.

8. The shield of claim 3 wherein said boron mineral includes colemanite.

* * * * *

UNITED STATES PATENT AND TRADEMARK OFFICE

CERTIFICATE OF CORRECTION

PATENT NO. : 4,727,257

DATED : February 23, 1988

INVENTOR(S) : Sergio Grifoni

It is certified that error appears in the above-identified patent and that said Letters Patent is hereby corrected as shown below:

In claim 1, line 5, change "which" to --with--.

Signed and Sealed this

Twenty-eighth Day of June, 1988

*Attest:*

*Attesting Officer*

DONALD J. QUIGG

*Commissioner of Patents and Trademarks*